United States Patent [19]

Gordon

[11] 4,051,366

[45] Sept. 27, 1977

[54] OPTICAL APPARATUS FOR SENSING CLUSTERED PACKAGE ORIENTATION

[75] Inventor: Jason Morse Gordon, Katonah, N.Y.

[73] Assignee: United Technologies Corporation, Hartford, Conn.

[21] Appl. No.: 645,590

[22] Filed: Dec. 31, 1975

[51] Int. Cl.[2] ..... H01J 39/12

[52] U.S. Cl. ..... 250/223 B; 198/378

[58] Field of Search ..... 250/223 R, 223 B; 356/240; 198/257, 378

[56] References Cited

U.S. PATENT DOCUMENTS

| | | | |
|---|---|---|---|
| 3,255,566 | 6/1966 | De Shazor, Jr. | 198/257 |
| 3,541,751 | 11/1970 | Quebe et al. | 198/257 |
| 3,618,743 | 11/1971 | Benatar | 198/210 |
| 3,639,067 | 2/1972 | Stephens | 356/240 |
| 3,808,447 | 4/1974 | Leavens, Jr. | 250/569 |
| 3,887,284 | 6/1975 | Gender et al. | 356/240 |

*Primary Examiner*—Alfred E. Smith
*Assistant Examiner*—David K. Moore
*Attorney, Agent, or Firm*—M. P. Williams

[57] ABSTRACT

Four six-packs of labeled bottles are picked up and spun while being illuminated by light sources, each of the 24 bottles have an optical sensor focused at a spot through which successive portions of the peripheral surface of the bottle passes as the bottle is spun. The six-packs are fed broadside first; the two center bottles in each six-pack remote from the sensors are illuminated by light, mounted adjacent thereto so that the lights pass between necks of bottles as the assembly approaches the four six-packs to pick them up. Certain of the sensors are longer than others to permit viewing of some bottles underneath the sensors related to other bottles. Each of the bottles is illuminated by a light positioned at an elevation which is substantially different than the elevation of the focus spot on the bottles so that the sensors are substantially insensitive to specular reflection from the shiny bottles, yet provide a substantial amount of light diffusely reflected from labels. Certain of the lights and sensors are arranged in line along the center of the apparatus between adjacent six-packs, and others of the sensors and lights are arranged in lines externally of all of the six-packs. The sensors focus on points which are at least one quarter revolution in advance of the desired stopping position of the bottles with respect to the direction in which the bottle is already spinning.

8 Claims, 6 Drawing Figures

OPTICAL APPARATUS FOR SENSING CLUSTERED PACKAGE ORIENTATION

BACKGROUND OF THE INVENTION

1. Field of the Invention

This invention relates to optical sensing of labels on rotating labeled containers.

2. Description of the Prior Art

As an adjunct in consideration of the predication of the present invention, consider various well-known practices for the packaging and display of beverage bottles and cans, such as for soft drinks and beer. As is known, beverage bottles and cans are frequently marketed in cluster packages, such as the well-known six-pack, and the emerging two-pack of larger containers. The well-known six-pack may be a cardboard wrap, in whch the ends are open; or it may be High-cone (TM), in which cans are held together by a thin molded network of soft plastic; or in a clear wrap, in which the containes are wrapped in a plastic which is then shrunk so as to grip them. In the latter two cases, there is no labeling of the cluster package, other than labeling on the individual containers therein; in the case of the cardboard wrap, cluster package labeling appears from a side view, but end view labeling is limited to the labeling on the individual containers. Quite obviously, since most round container labels (particularly bonded paper labels) cover only 120° of the container periphery, there is a more than 50 percent chance that full product identification will not be readable on at least some of the containers when the cluster package is disposed on a shelf for viewing by consumers. It is, therefore, desirable and advantageous to rotate the containers before assemblage in the cluster package to ensure that any container labels which are to be used for product identification while on the display shelf are rotated in such a fashion that the labels bearing product identification will be clearly visible to the consumer.

When orienting labels, the containers may be preclustered on the packaging machine and may be rotated the desired amount prior to arriving at the first packaging station. The containers should be viewed in some fashion while being rotated, and the rotation ceased when the viewing apparatus detects that the package is in the proper position. The techniques of gripping and rotating containers have been well known for many years in the package handling arts. However, the technology of viewing and of processing the resulting signals has heretofore left much to be desired. For instance, the technology for utilizing normal white light, which thereby permits the use of relatively inexpensive and highly available television-type equipment, is most advantageous; on the other hand, optical considerations—such as reflections from minor flaws, changes in ambient light as a result of surrounding procedures, transients from many different sources and the like—create difficulties in producing signals in response to ordinary white light. Additionally, the economics of beverage packaging are extremely critical; although a single bottle, can or other container may be processed at one time or a single cluster (such as a six-pack) may be processed at one time, the cost of such processing relative to the production rate of packaging of six-packs and the like may be prohibitive, since the containers must be packaged at a rate commensurate with the rate of other processing on an automated line. The on-line sensing must be powerful enough to avoid reducing production rates below those which are permissible, and to avoid the need of several computers or other signal processors.

In the container handling arts, apparatus is known which rotates containers, such as bottles and cans, and stops them in the desired position, either to check label registration (whether they be bonded paper labels or painted labels), or for other purposes. However, in such systems known to the art there is usually required a special sensing mark of some sort on the container, and most such devices are capable of orienting only one container at a time. Obviously, a multiplicity of such devices would be required in the event of usage with an assembly line which processes a large number of bottles in parallel at one time.

Additionally, in the event that cluster packaging is involved, it is difficult to process a single container at a time since there is a need to have the containers arranged in clusters as well as being properly oriented at the time of packaging. When complex electronic equipment is involved, it is desirable to utilize the electronic equipment for as many containers in one processing batch as possible, to minimize the amount of equipment required in order to process sufficient containers at the processing rate of the overall system. In some systems, the processing of the containers is already provided for, and the orienting equipment is to be added thereto as a retrofit. In some of these systems, the clusters of containers (such as six-packs) may be processed broadside, that is, with the long side of the cluster (or six-pack) arranged in the forward and aft direction and the short sides facing laterally of the processing line. This presents additional difficulties to optical sensing equipment since the two center containers in a six-pack (for instance) are not available at the edges of the production line, and must be accommodated in a special fashion.

SUMMARY OF THE INVENTION

Objects of the present invention include provision of improvements in optical sensing of labeled containers which are to be oriented in a cluster.

According to the present invention, a plurality of spinning, labeled containers are illuminated and viewed by corresponding sensors which are disposed to sense the lightness and darkness of the peripheral surface of a labeled container, thereby to detect discernible differences in the pattern of the peripheral surface which identify particular orientations of the labeled container with respect to a desired orientation in the cluster.

According further to the present invention, optical detectors are disposed to view successive elementary spots on the peripheral surface of spinning, labeled containers which are in a plane different than the plane from which the illumination of the containers eminates. The optical sensors and related optical sensing system provide sensing for a plurality of clusters of containers, there being more than one cluster in the direction of movement and more than one cluster in a direction normal to the movement of the containers in a processing line. In further accord with the invention, illumination sources and optical sensing means are disposed longitudinally of a processing line, along the edge thereof and in the center thereof. In still further accord with the present invention, optical sensors are of different length in order to permit clear viewing of distinct areas without interference from one another.

In accordance further with the present invention, the optical sensors disposed for sensing optical indicia on the peripheral surface of spinning labeled containers arranged in a plurality of clusters, in both the longitudinal and transverse directions of the container travel, are disposed in a manner to provide as much clearance as possible between the field of view of the optical sensor and containers other than those with which the sensor is uniquely related.

In accordance still further with the present invention, the optical sensors are placed to sense label edges a significant fraction of a revolution before the position of such edges when the containers are stopped at the desired orientation.

The present invention permits processing of multiple container clusters at a single time, such as four six-packs, as set forth in the exemplary embodiment herein. The invention permits sensing labeled container orientation of all of the containers disposed in clusters as the containers are spinning even containers which, due to broadside processing (viewing a cluster from the end) are not adjacent to the edges of the path through which the containers pass during sensing. The invention provides compact, high throughput labeled container orientation sensing which is reliable and operates without interference between containers.

The foregoing and other objects, features and advantages of the present invention will become more apparent in the light of the following detailed description of a preferred embodiment thereof, as illustrated in the accompanying drawing.

DESCRIPTION OF THE PREFERRED EMBODIMENT

Figure 1:
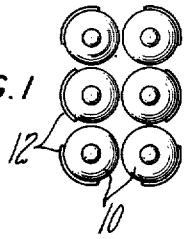
FIG. 1 is an illustrative, top plan view of a six-pack of bottles oriented for visible display of the labels thereon.

Referring now to FIG. 1, a cluster of containers, such as bottles 10, each have a label extending approximately one-third of the way around its peripheral surface. The bottles 10 are shown positioned with a desired mutual orientation such that the labels of the two center bottles are pointing orthogonally from the side of the bottle cluster, and the labels of the end bottles are pointing at roughly 45° with respect to the cluster. This provides a high degree of product identification from the label information alone, whether the cluster be viewed from the end or the side. This therefore facilitates marketing of the cluster of bottles in clear plastic wrap without any further product identification on the wrapper. However, in the utilization of the invention, the ultimate positions of the labels is virtually immaterial, since each bottle may be stopped at a point determined by a settable delay which defines the amount of rotation to be imparted to the bottle after the label edge is sensed. Therefore, the end bottles may be oriented with their labels pointing orthogonal to the ends of the cluster so as to permit viewing of the bottle label information when the cluster is packaged in an open-end cardboard wrap. Similarly, the inherent nature of the invention makes it useful to accommodate virtually any desired bottle orientation configuration.

Further, although six bottles are described with respect to FIG. 1 as representative of but one well-known cluster arrangement (the six-pack) the invention relates to sensing a plurality of clusters, and can readily handle two-packs, four-packs, eight-packs and the like. In fact, the embodiment of the invention described hereinafter is arranged to sense four six-packs at one time, thus providing a high production rate with but a single, relatively simple apparatus.

Figure 2:
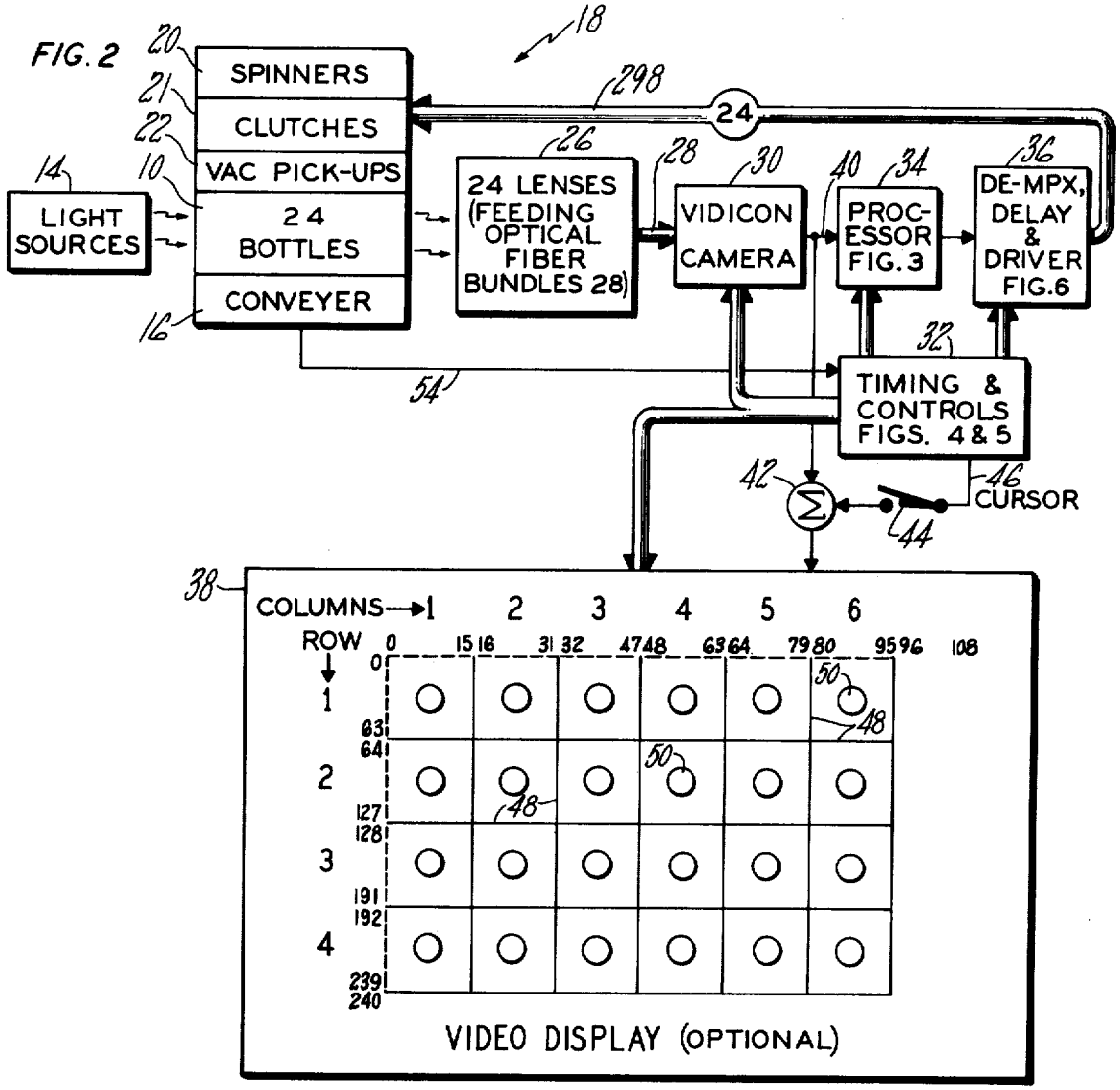
FIG. 2 is a simplified schematic block diagram of an exemplary embodiment of a system which may incorporate the present invention.

Referring now to FIG. 2, there is shown an exemplary overall system employing the present invention, concerning which reference may be had to commonly owned copending application Ser. No. 645,844 and now U.S. Pat. No. 3,997,780 LABELED CONTAINER ORIENTATION SENSING SYSTEM, filed on even date herewith by G. C. Waehner. Therein, 24 bottles 10 are illuminated by simple light sources 14 as they are advanced along a path in a packaging machine by conveyors 16. At some point along the path, an assembly 18, carrying 24 spinners 20 attached by clutches 21 to vacuum pick-ups 22, is lowered over the bottles so that the bottles may be raised just enough to provide clearance from the conveyor, so that with the clutches engaged, the spinners can rotate the bottles. At this point, the bottles are spaced in clusters of six in preparation for being wrapped in six-packs; however, the relative, rotative orientation with respect to each other is completely random at this point. The mechanical vacuum pick-up, clutch and spinning apparatus 16-22 is of any suitable type well known in the package handling art, forms no part of the present invention, and is therefore not described further herein.

There are twenty-four optical sensing stations 26 (described more fully with respect to FIGS. 3–6 hereinafter) feeding optical fiber bundles 28, and which consist of mirrors for altering the direction of light, and lenses focused at spots on the periphery of the bottle, across which the surface area of the bottle and the label will pass as the bottles are rotated by the spinners 20. Preferably, the optical stations 26 are mounted on the assembly 18 as are the lights 14, so that the assembly 18 may engage bottles and move forwardly with them along the conveyor a sufficient time to properly orient all of the bottles, after which it raises so as to disengage from those bottles, returns rapidly along the conveyor to a subsequent grouping of bottles and engages them, and again follows the bottles along the conveyor for a period of time sufficient to properly orient all of them.

In the present embodiment, the leading edge of the label, in the direction of the spinning of the bottle, is taken as the point of detection of the position of the container; therefore, in this embodiment the label edge is detected by a solid string of dark indications followed by a solid string of light indications. This implies, in part, a dark bottle having a light label thereon; but it is also achievable, in part, by arrangement of the light with respect to the optical sensing station 26, such that specular reflection (mirror-like reflection) of the light from the bottles is directed away from the optical stations 26, whereas diffuse reflection (which is minimal at the bottle surface and large at the rough label surface) has significant components directed toward the optical stations 26. As is described more fully hereinafter, this selective reflection characteristic is achieved by locating the light sources above the label, with the optical sensing stations 26 located more or less on the same vertical plane as the spot being sensed on the bottles, such that specular reflection is downward, below the optical sensing stations 26, whereas the diffuse reflection (having significant horizontal components) will present significant light to the optical sensing stations 26.

The light pipes, such as fiber bundles 28, feed a vidicon camera 30 which provides, in the usual fashion, a time varying signal of video during each of many horizontal scans contained within each vertical scan (non-interlaced frame). In the present embodiment, there are 240 active horizontal scans (in addition to blanked lines) for each frame in a non-interlaced raster which is controlled by digital clock signals provided by the timing and control circuitry 32 which also controls a processor 34 (as is described more fully in said copending application) and the demultiplex, delay and driver circuitry 36, which in turn controls deactivation of the clutches 21 to permit the bottles to stop in a desired relationship to the sensing of the label edge. If desired, and particularly for purposes of initial alignment of the system, a video display 38 may be provided; although it should be understood that the video display 38 performs no function (other than initial alignment) having anything to do with the bottle orientation of the present invention.

The vidicon camera output is supplied on a line 40 to the processor, and is also supplied to a video summing junction 42 which also receives a video signal from a switch 44 which may selectively be closed so as to apply a cursor signal on a line 46, which is generated in the timing and control circuitry 32. With the switch 44 closed, the cursor signal will generate a partial grid work, illustrated by the solid line 48 in the video display 38, which permits mutual alignment of the optical fiber bundles 28 with the field of view of the vidicon camera 30 such that the spots 50 of lightness presented by the optical fiber bundles 28 will be more or less centered within the boxes defined by the cursor display 48. Naturally, the video display 38 is controlled in a fashion similar to the control of the vidicon camera by digital clocking signals which control its horizontal and vertical synchronization and unblanking, provided by the timing and control circuitry 32.

Referring to the illustrations set forth on the video display 38 in FIG. 2, the vidicon camera 30 scans from left to right across substantially its entire field of view. Each scan (for convenience, as is explained hereinafter) is subdivided into 130 horizontal clock signals, of which 109 (0–108) represent the unblanked, active portion of the scan, although only 96 of these horizontal clock signals (0–95) actually represent the horizontal window within which the processor is responsive to the output of the vidicon camera; the remainder (above 108) being blanked time, at which the horizontal sweep is restored to the left side as viewed in FIG. 2. Similarly, vertical clock signals, produced by the timing and control circuitry 32 in response to the horizontal clock signals, causes the vertical sweep to be unblanked for 240 vertical clock signals (each of which contain the 130 horizontal clock signals) the remainder of the vertical sweep (consisting of a total of 260 vertical clock signals) being blanked time in which the vertical sweep is restored to the top of the field of view (as viewed in FIG. 2).

As is shown in the illustration of the video display 38, the digital clock signals subdivide the active portion of the vidicon camera field of view into 24 squares, each aligned to contain the image 50 of one of the 24 optical fiber bundles 28 which, in turn, is responsive to one of the 24 optical sensing stations 26. Thus each of the squares in the display corresponds to one of the bottles. However, it is not necessary that any one or any group of the squares be particularly related to any one or a group of the bottles (such as four six-packs of bottles) since any bottle may be assigned to any of the 24 processing channels, the relationship between the bottle and the channel simply being that it has suitable delay from label edge detection to the desired stopping position of the bottle, which delay can readily be provided for any bottle. For purposes of illustration herein, the horizontal lines which compose one frame during a single vertical sweep are clustered in four groups identified as rows 1 through 4. Thus row 1 contains lines 0–63, and so forth. Each row, and the entire frame, are also subdivided by horizontal timing bits into groups identified as columns 1 through 6. That is, during each of the horizontal clock times (0–95) for each horizontal scan of the vidicon camera 30, there are 96 samplings of the vidicon camera video on th line 40. These samplings are referred to as elements 0–95, such that: column 1 consists of elements 0–15; column 2 consists of elements 16–31; and column 6 consists of elements 80–95. The columns and their constituent elements and the rows and their constituent lines are used to identify signals which occur at commensurate times in response to the digital clocking signals. Thus a signal identified as "first element" occurs at times commensurate with horizontal clock signals 9, 16, 32, 48, 64, 80 and 96. Similarly, a signal identified as "last lines " means the last line in each of four rows, generated by vertical clock signals 63, 127, 191 and 239; similarly "first lines" consists of vertical clock signals 64, 128, 192 and 240.

Synchronization between the conveyor 16 (FIG. 2) and the electronic processing circuitry of the present invention is achieved by means of a machine reset signal on a line 54. When the assembly 18 clears a current set of bottles 10, and is restored upstream along the conveyor so that it may engage another set of bottles 10, it provides the machine reset signal on the line 54. Because of the fact that the frame rate of the present embodiment is based upon the vertical scan rate and therefore on the vertical synchronization signal generated for the vidicon camera, which occurs approximately at 60 Hz or every 16.7 microseconds, and the time for retoring the assembly 18 may be on the order of several seconds, there are many vertical synchronization signals generated defining many vidicon camera frames during the machine reset signal on the line 54. Although the digital clock continues to run in the electronic processing apparatus, nothing happens therein until the end of the machine reset signal on line 54; then, the very next vertical synchronization signal causes the end of the system reset, at which time system operation begins. Since the bottles may be in any position when the system reset signal ends, there is no way of telling how long (how many electronic frames, determined by vertical synchronization signals) it will take before all the bottles have their label edges sensed and their stop signals generated; but it must take at least eight frames since an 8-bit pattern is utilized in the embodiment of said copending application. In any event, depending upon the arbitrary rotation of the bottle at the time the bottle is picked up and on its ultimate desired position, the sensing of the label edges and generating of the stop signals occurs on a random and arbitrary basis. In the present embodiment, there is sufficient time in the movement of the bottles along the conveyor with the assembly 18 engaging them, to ensure that all bottles will rotate sufficiently (up to one and a half full revolutions) to be sensed and stopped in the proper position. When the conveyor has advanced to the position at which the assembly 18 disengages from the bottles, a new machine reset signal will be generated causing resetting of the processor 34 and generation of the system reset. Once the assembly 18 has engaged a new set of bottles, the spinning, sensing and stopping will again be repeated.

The foregoing is a very brief description of one embodiment of processing equipment which may utilize the present invention for sensing the orientation of the spinning, labeled containers, which embodiment is described in the aforementioned copending application, which is incorporated herein by reference. In that application, there is also described a somewhat simpler embodiment utilizing photodetectors instead of a vidicon camera, and with a generalized pattern such that label pattern detection can be used, rather than label edge detection, to determine the instantaneous orientation of the spinning, labeled containers. The particular processing involved is not germane to the present invention, which relates to sensing of lightness and darkness of spinning, labeled containers.

Figure 6:
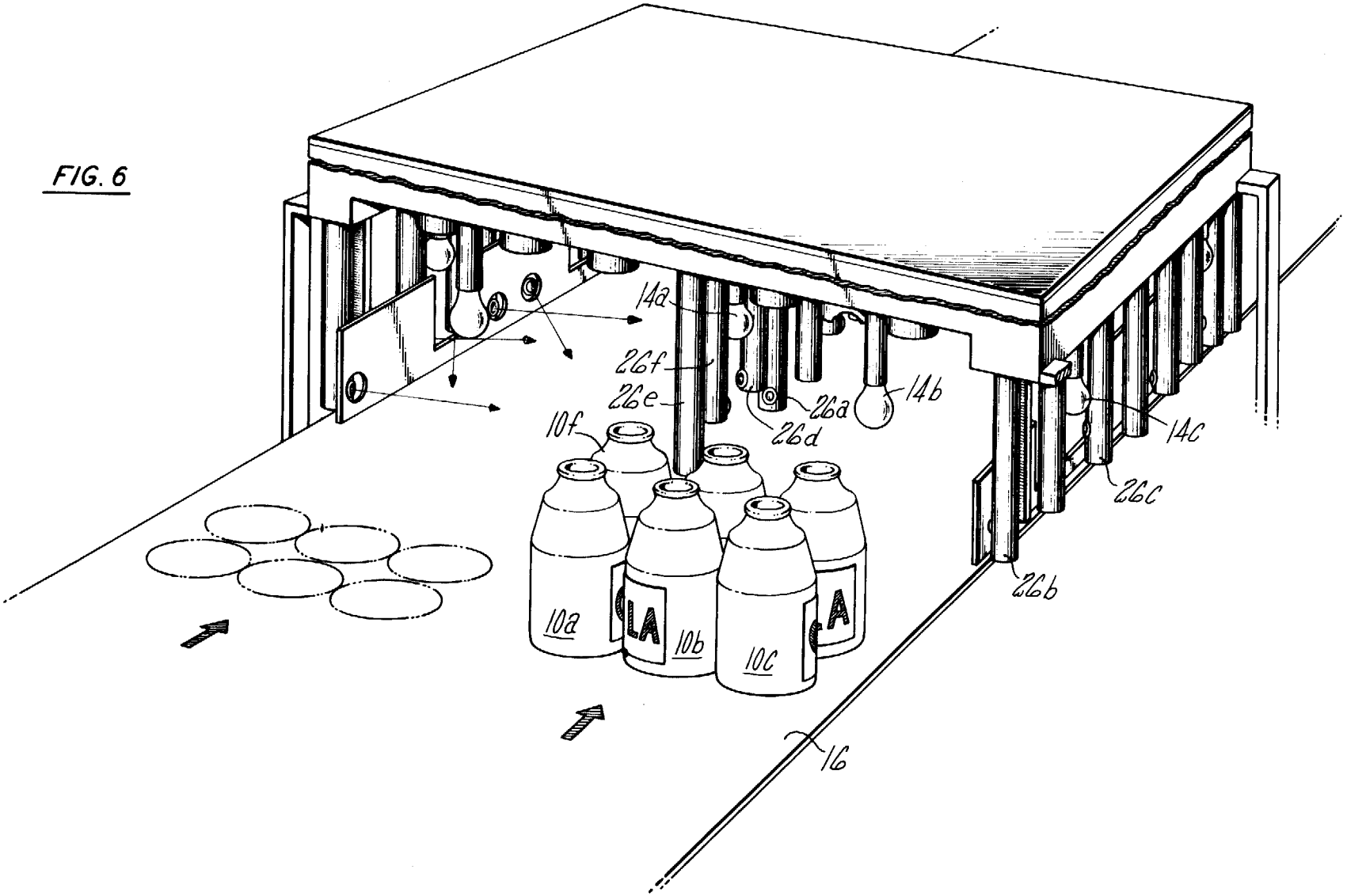
FIG. 6 is a simplified, plan view of the exemplary embodiment of the invention.

Because of the symmetry of the apparatus with respect to any given six-pack, as is readily apparent in FIG. 6, only a few of the bottles, light sources and sensors are described, similar reasoning appertaining to the remainder thereof in a corresponding fashion.

Figure 3:
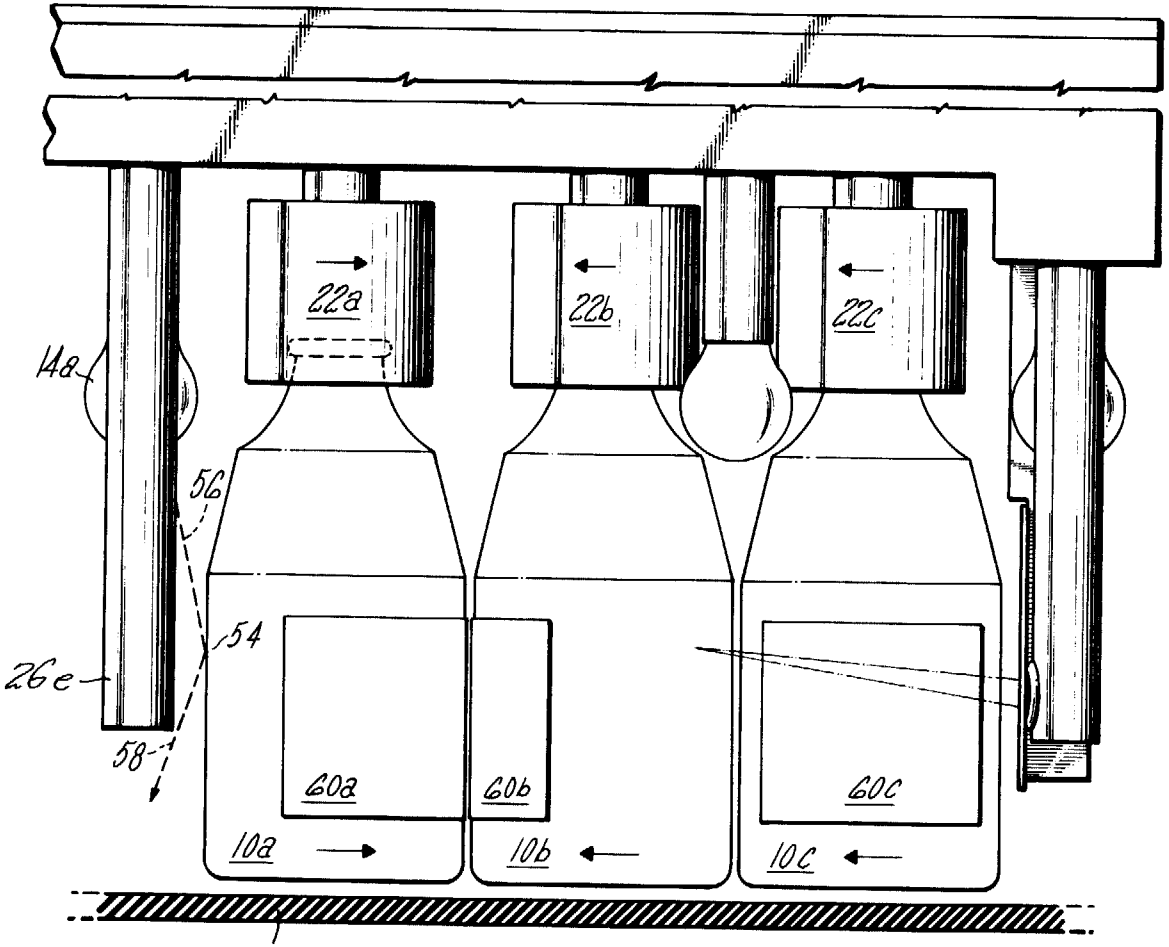
FIG. 3 is a simplified perspective view of the exemplary embodiment of the present invention.
Figure 4:
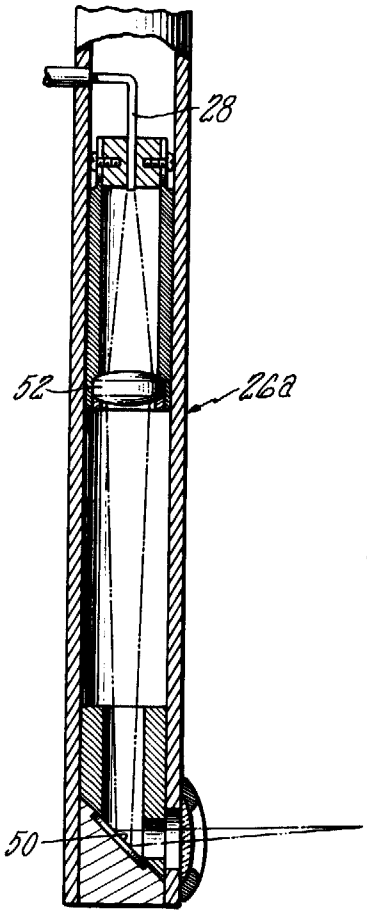
FIG. 4 is a sectioned side elevation view of an optical sensor for use in the embodiment of the present invention.
Figure 5:
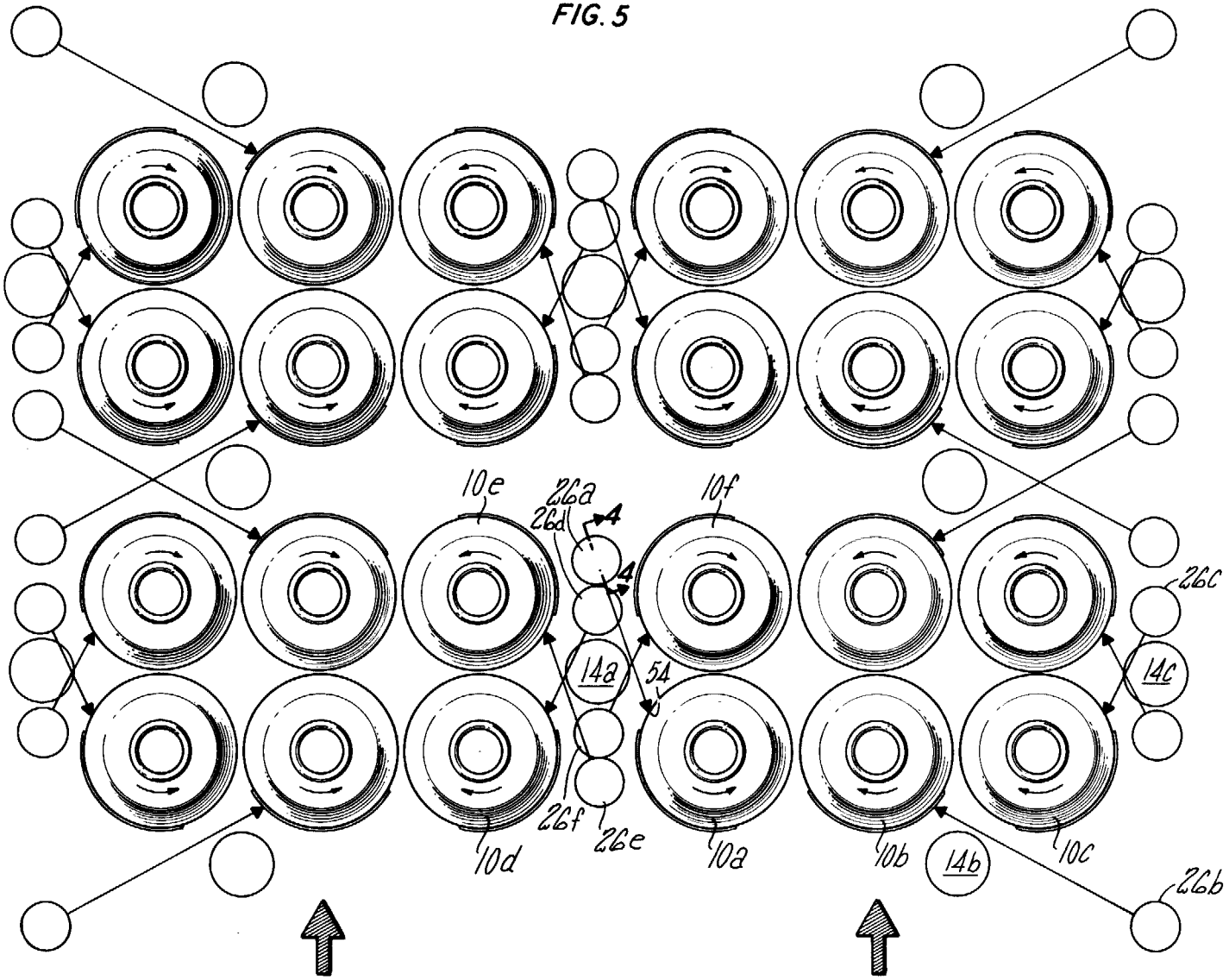
FIG. 5 is a simplified, partial side elevation view of the exemplary embodiment.

Referring now to FIG. 3, the plurality of bottles 10*a*–10*c* are engaged by spinning vacuum pick-ups 22*a*–22*c* and lifted above the conveyor 16 so that they may be spun, as indicated by the arrows at the base of each bottle in FIG. 3 and more fully by the arcuate arrows in FIG. 5. The spinners 20 and clutches 21 (FIG. 2) are not shown in FIGS. 3–6 for simplicity, and comprise apparatus of any type known in the art to permit selective spinning of the bottles 10.

Associated with the bottle 10*a* is an optical sensing station 26*a* (FIG. 5) which, as shown in detail in FIG. 4, consists of a mirror 50, a lens 52 and an optical light pipe which may comprise optical fiber bundles 28, or may comprise a single optical fiber, as may be found desirable to suit any given implementation of the invention. If a bundle of fibers is used, then there may be on the order of 36 fibers, each 5 mils in diameter, to make up a bundle on the order of 47 mils in diameter. On the other hand, a single optical fiber of on the order of 30 mils may be used if desired. The lens 52 (as is true of the other lenses herein) may be a simple positive lens having a focal length of on the order of 1¼ inches. The lenses are preferably acchromatic triplets consisting of three elements, each having a different index of refraction in order to provide color correction, such that substantially all wave lengths of visible light will focus at the same point, as is well known in the art. The mirrors 50 simply provide a change in the direction of light thereby to permit utilization of a vertical lens system which more easily fits between bottles moving on a conveyor system (as shown in FIG. 5). As is described in the aforementioned copending application, rather than using optical fibers 28 feeding a vidicon camera 30, the lens 52 may instead focus the light on photodetectors which provide electrical signals representing the degree of lightness or darkness at the spot 54 (FIG. 5) on the bottle at which each optical sensor is focused.

As seen in FIG. 3 the light 14*a*, which illuminates the bottle 10*a* to be sensed by the sensing station 26*a*, is located some distance (roughly half a bottle) higher than the point 54 which is focused upon by the sensor 26*a*. As a result, the light (illustrated by the dash line 56) which impinges on the focus point 54 is specularly reflected downwardly (as illustrated by the dash line 58) thereby to provide a relatively small amount of light to the mirror 50; however, in response to diffuse reflection as results from a paper label 60*a* of sufficient lightness, the reflected light has a sufficient horizontal component so as to provide a significantly greater amount of light to the ends of the fiber bundles 28. This then, in accordance with the invention, permits a high degree of sensitivity to the difference between a bare bottle and a label.

Referring now to FIGS. 5 and 6, there is shown an arrangement for sensing the orientation of four six-packs at one time according to the invention. Therein, it can be seen that the bottle 10*a* is being sensed by the sensor 26*a* along a path which passes under a sensor 26*d* associated with a bottle 10*d*. Therefore, as is shown in FIG. 6, the sensor 26*a* is somewhat longer than the sensor 26*d* (and is broken away in FIG. 3 for simplicity of illustration). The sensor 26*a* has its mirror adjusted so that it looks slightly upward to the focal point 54 on the bottle 26*a*, whereas the sensor 26*d*, being shorter, has its mirror 50 oriented so as to look slightly downward to the focus point on the bottle 10*d*. Similarly, a sensor 26*e* is longer than a sensor 26*f* so as to view bottles 26*e* and 26*f*, respectively, without obstruction. This feature of the invention permits utilization of but a single lamp in the center of the conveyor system between the bottles 10*a*, 10*d* and 10*e*, 10*f* (and related bottles) while providing the lamp and the sensors close enough to the bottles being sensed for a sufficiently high optical sensitivity. With respect to other bottles, this high optical sensitivity is also maintained by the invention. For instance, the optical sensor 26*b* (FIG. 5) must of necessity be located some distance from the bottle 10*b*, since the bottle 10*b* is isolated from the edges of the six-pack by the bottles 10*a* and 10*c*. However, the light source 14*b* is located quite close to the bottle 10*b* such that the bottle has a high degree of illumination that provides the requisite optical sensitivity. Also, the light source 14*b* is mounted to pass between the necks of the bottles 10*b*, 10*c* as the assembly 18 moves relative to the bottles when advancing from one group of bottles to the next. It is also to be noted in FIG. 5 that, in accordance with another feature of the invention, all of the optical sensors are located, with respect to the related light sources and the bottle being sensed, so as to provide acute angles between the direct illumination from the light source and the path from the focus point on the bottle to the sensor. This maximizes the amount of diffuse reflection which can be had from the label even though the horizontal displacement between the light sources and the mirrors of the sensing elements causes the specular reflection into the sensors to be minimal (as is illustrated in FIG. 3).

As is evident in FIG. 5, another aspect of the present invention is providing for the sensing of bottles (10*a*, 10*f*, 10*d*, 10*e*) at the inner ends of two six-packs by a cluster of four sensors (26*a*, 26*f*, 26*d*, 26*e*) in the center of the assembly, so that sensors (such as 26*b*) the edges of the assembly may sense the center bottles (such as 10*b*) in each of the six-packs, thus providing for eight sensors in each of the three rows, two of the rows being on the outside edges and one of the rows being between related pairs of six-packs. Thus the invention provides for the sensor 26b (and similar sensors) to be located on the outside edge, since only four sensors are required to sense the outside bottles in each of the two six-packs on that side of the assembly in line with the sensor 26b.

Another aspect of the present invention is illustrated by the bottles 10a–10c in FIG. 5. The rotation of the bottles (illustrated by the arcuate arrows) is different for different bottles. Specifically, the rotation is such that the presence of the leading edge of the label (in the direction of the rotation of the bottle) can be detected at the focus point of the sensor (as is illustrated by the long straight arrows in FIG. 5) so that there is at least a quarter of a revolution from the sensing of the label edge to the point where the bottle is desired to be stopped; however 20° is adequate. Thus the label 10b will be stopped so that it will be facing laterally outward from the side of the six-pack (approximately a third of revolution from the position where the edge of the label 60d is sensed, as seen in FIG. 4). On the other hand, if the bottle 10b were rotated in the opposite direction (clockwise as viewed in FIG. 4), the bottle would have to be stopped just a few degrees after sensing the label edge or else would have to be allowed to rotate another fulll revolution plus a few degrees before stopping. However, in high through-put processing apparatus, the wasting of an entire revolution of bottle spinning can be prohibitive; this is particularly true since as much as one and a half revolutions may be required in order to sense and stop the bottle due to the arbitrary orientation of the bottle (the position of its label as it enters the assembly 18, as shown in FIG. 3) being uncontrolled and unknown. Thus, the relationship between the position of the sensor with respect to the focal point on the bottle and the direction in which the bottle spins, in accordance with the invention, permits sensing the label edge a sufficiently large fraction of a revolution before the desired stopping position of the bottle to allow for declutching, inertia and other mechanical factors which should be apparent to those skilled in the art.

Although some of the features described hereinbefore relate to multiple clusters (such as the four six-packs processed in the embodiment described herein), certain of the features are equally applicable in a sensing system which may sense only a single six-pack, or two six-packs in line with one another in the direction of motion of the conveyor, or clusters of other sizes. For instance, the relationship between the position of the sensor with respect to the focus on the bottle, the direction of rotation on the bottle, and the point of stopping at the desired orientation of the label with respect to the cluster, is applicable to sensors which may process only one cluster at a time, or only pairs of clusters disposed longitudinally of each other in a direction of travel of the conveyor system. This is also true of the arrangement of the lights 14 with respect to the mirrors 50 of the sensors, which controls the sensitivity between specular and diffuse reflection; and of the fact that each sensor is focused on a path which is tangential to the surface of any close containers other than the related container, as seen in FIG. 5.

The relatively long distance between the bottle 10b and its sensor 26b (and similar, internally disposed bottles) is accommodated by the closeness of its light source 14b. It is to be noted that due to the focal length requirements of the sensors 26, their dimensions are such to prohibit passing between the necks of bottles, whereas the light source 14b (and similar sources) being disposed at a higher elevation with respect to the conveyor 16 will clear the bottles prior to the bottles being picked up of the conveyor (as in FIG. 3) by the vacuum pick-ups 22. The relationship between the light source 14b which is disposed on the assembly 18 in such a fashion that it passes between the necks of bottles as they travel under the assembly 18 prior to pick up, versus the edge-position of the sensor 26b which permits it to have a much larger vertical dimension, is another aspect of the present invention. The invention can be used to orient any number of containers, without regard to content (e.g., spice, dog food, etc.), shape or material (glass, metal, paper).

Although the invention has been shown and described with respect to a preferred embodiment therefore, it should be understood by those skilled in the art that the foregoing and various other changes, omissions and additions may be made therein and thereto without departing from the spirit and the scope of the invention.

Having thus described a typical embodiment of my invention, that which I claim as new and desire to secure by Letters Patent is:

1. A subassembly for optically sensing the orientation of a plurality of labeled containers spinning, on axes, at respective stations on an associated container handling assembly, comprising:

a plurality of light sources disposed substantially in a first plane, there being fewer of said light sources than containers illuminated thereby;

a plurality of optical sensors thus disposed in longitudinally extending tubular housings mounted with their axes parallel to the spin axes of the containers, one for each of the containers, each having an optically-sensitive aperture focused at a spot substantially in the path of the peripheral surface of a related rotating container and in a plane separated from said first plane by a distance which is sufficiently great so as to render said sensors substantially insensitive to specular reflection of light reflecting from containers illuminated by said light sources, yet sufficiently small so as to render said sensors substantially sensitive to diffuse reflection of light reflecting from labels on the containers illuminated by the light sources.

2. Apparatus according to claim 1 wherein said housings extend between said two planes, some of said housings being longer than others of said housings and the corresponding sensor of at least one of said longer housings being focused at the related spot along an optical path passing beyond the extremity of one of said others of said housings.

3. Apparatus according to claim 1 wherein the projection of the angle between the path of illumination from each one of said light sources to a related spot illuminated thereby and the path from such spot to the corresponding aperture on a plane parallel to said first plane is an acute angle.

4. In apparatus for engaging and spinning a plurality of containers, on axes, arranged in at least two clusters which are disposed laterally of each other with respect to the direction of motion of said containers along a pair of processing paths, a subassembly for optically sensing the orientation of spinning, labeled containers, comprising:

a first light source disposed on said assembly between said pair of paths;

a set of first optical sensors thus disposed in longitudinally extending tubular housings mounted with their axes parallel to the spin axes of the containers disposed on said assembly between said pair of paths, each of said first sensors being focused to sense light impinging on a spot on the periphery of a related container in one of the clusters of containers;

second and third sets of optical sensors thus disposed in longitudinally extending tubular housings mounted with their axes parallel to the spin axes of the containers disposed at respective sides of said pair of paths opposite from said first sensors, each of said second and third sets including at least one sensor focused to sense light impinging on a spot on the periphery of a related container in a corresponding cluster which is adjacent to said sensor at an end of said cluster opposite from said first sensors; and a pair of second light sources, each disposed with a corresponding one of said second and third sets of sensors, each for illuminating the containers in the related cluster.

5. Apparatus according to claim 4 wherein said set of first sensors includes sensors of different physical length, thereby providing for certain of said sensors to be focused along viewing lines which pass beyond the extremity of others of said sensors and would otherwise be blocked thereby.

6. A subassembly for optically sensing the orientation of a plurality of labeled containers spinning, on axes, at respective stations on an associated container handling assembly, comprising:

a plurality of light sources; and a plurality of optically sensors thus disposed in longitudinally extending tubular housings mounted with their axes parallel to the spin axes of the containers, one for each of the containers, each having an optically-sensitive aperture focused at a spot substantially in the path of the peripheral surface of a related rotating container along an optical path which is substantially tangential to any container proximate thereto except the related container, so as to render each of said sensors substantially insensitive to reflection of light from unrelated containers illuminated by said light sources, yet render said sensors substantially sensitive to reflection of light from the related container.

7. In apparatus for engaging and spinning a plurality of containers, on axes, arranged in at least two clusters which are disposed laterally of each other with respect to the direction of motion of said containers along a pair of processing paths, each cluster including containers at the lateral ends thereof and containers therebetween remote from the ends thereof, a subassembly for optically sensing the orientation of spinning, labeled containers, comprising:

a first light source disposed on said assembly between said pair of paths;

a set of first optical sensors thus disposed in longitudinally extending tubular housings mounted with their axes parallel to the spin axes of the containers disposed on said assembly between said pair of paths, each of said first sensors being focused to sense light impinging on a spot on the periphery of a related container in one of the clusters of containers;

second and third sets of optical sensors thus disposed in longitudinally extending tubular housings mounted with their axes parallel to the spin axes of the containers disposed at respective sides of said pair of paths opposite from said first sensors, each of said second and third sets including at least one sensor focused to sense light impinging on a spot on the periphery of a related container in a corresponding cluster which is adjacent to said sensor at an end of said cluster opposite from said first sensors, and including a sensor similarly related to a container in said corresponding cluster which is located remotely from either end of said corresponding cluster;

a pair of second light sources, each disposed with a corresponding one of said second and third sets of sensors, each for illuminating the containers in the related cluster; and a plurality of a third light sources, each disposed on said assembly at a point which is transversely distant from either end of a related one of said clusters of containers, at a point which is adjacent a corresponding one of said containers that is located remotely from either end of the related cluster.

8. In apparatus for engaging and spinning a plurality of containers, on axes, arranged in at least two pairs of two clusters per pair, each pair being disposed laterally of each other with respect to the direction of motion of said containers along a pair of processing paths, each cluster including containers at the lateral ends thereof and containers therebetween remote from the ends thereof, a subassembly for optically sensing the orientation of spinning, labeled containers, comprising:

a first pair of light sources, each disposed on said assembly between said pair of paths and between a related pair of said laterally disposed clusters;

a pair of sets of first optical sensors thus disposed in longitudinally extending tubular housings mounted with their axes parallel to the spin axes of the containers disposed on said assembly, each set between said pair of paths and between a related pair of cluster, each of said first sensors being focused to sense light impinging on a spot on the periphery of a related container in one of the clusters of containers;

a pair of second and third sets of optical sensors thus disposed in longitudinally extending tubular housings mounted with their axes parallel to the spin axes of the containers, each said second and third set being disposed at respective sides of said pair of paths opposite from said first sensors, each of said second and third sets including at least one sensor focused to sense light impinging on a spot on the periphery of a related container in a corresponding cluster which is adjacent to said sensor at an end of said cluster opposite from said first sensors, and including a sensor similarly related to a container in said corresponding cluster which is located remotely from either end of said corresponding cluster;

a pair of second light sources, each disposed with a corresponding one of said second and third sets of sensors, each for illuminating the containers in the related cluster; and a plurality of a third light sources, each disposed on said assembly at a point which is transversely distant from either end of a related one of said clusters of containers, at a point which is adjacent a corresponding one of said containers that is located remotely from either end of the related cluster.

* * * * *